US010900395B2

(12) United States Patent
Burkert

(10) Patent No.: US 10,900,395 B2
(45) Date of Patent: Jan. 26, 2021

(54) OIL-SEPARATING DEVICE

(71) Applicant: Polytec Plastics Germany GmbH & Co. KG, Lohne (DE)

(72) Inventor: Tobias Burkert, Osnabrück (DE)

(73) Assignee: Polytec Plastics Germany GmbH & Co. KG, Lohne (DE)

( * ) Notice: Subject to any disclaimer, the term of this patent is extended or adjusted under 35 U.S.C. 154(b) by 0 days.

(21) Appl. No.: 16/495,273

(22) PCT Filed: Apr. 24, 2017

(86) PCT No.: PCT/EP2017/059661
§ 371 (c)(1),
(2) Date: Sep. 18, 2019

(87) PCT Pub. No.: WO2018/171906
PCT Pub. Date: Sep. 27, 2018

(65) Prior Publication Data

US 2020/0088076 A1 Mar. 19, 2020

(30) Foreign Application Priority Data

Mar. 20, 2017 (DE) ..... 20 2017 101 622 U

(51) Int. Cl.
*F01M 13/00* (2006.01)
*F01M 13/04* (2006.01)
*F01M 13/02* (2006.01)

(52) U.S. Cl.
CPC ..... *F01M 13/04* (2013.01); *F01M 13/0011* (2013.01); *F01M 13/021* (2013.01);
(Continued)

(58) Field of Classification Search
CPC . F01M 13/04; F01M 2013/0016; B01D 45/08
(Continued)

(56) References Cited

U.S. PATENT DOCUMENTS 3,386,469 A * 6/1968 Kelly ..... G05D 16/0641 137/505.38
2010/0101425 A1* 4/2010 Herman ..... B01D 45/08 96/400

(Continued)

FOREIGN PATENT DOCUMENTS

DE 102014223291 5/2016
DE 102015101181 7/2016
DE 102015101181 A1 * 7/2016 ..... F01M 13/04

OTHER PUBLICATIONS

International Preliminary Report on Patentability of PCT/EP2017/059661, dated Sep. 24, 2019, 6 pages.

(Continued)

*Primary Examiner* — Long T Tran
*Assistant Examiner* — James J Kim
(74) *Attorney, Agent, or Firm* — Rankin, Hill & Clark LLP

(57) ABSTRACT

An oil separation device includes an oil separator in a housing between a gas inlet and an outlet. An opening is formed at the longitudinal end of a gas-conducting channel connected to the gas inlet the end facing away from the gas inlet, and a throttle aperture movably mounted in the longitudinal direction of the gas conducting channel. The gas conducting channel and an outlet channel form an annular gap through which crankcase ventilation gases flow via a nozzle gap, and the housing has an additional opening to which a reference pressure can be applied on the throttle aperture side facing away from the gas conducting channel. The throttle aperture extends radially beyond the annular gap and has a seal region molded onto the edge that is sealingly arranged in a recess formed in the housing such that the throttle aperture fluidically separates the additional opening from the gas inlet.

14 Claims, 6 Drawing Sheets

Figure 1:
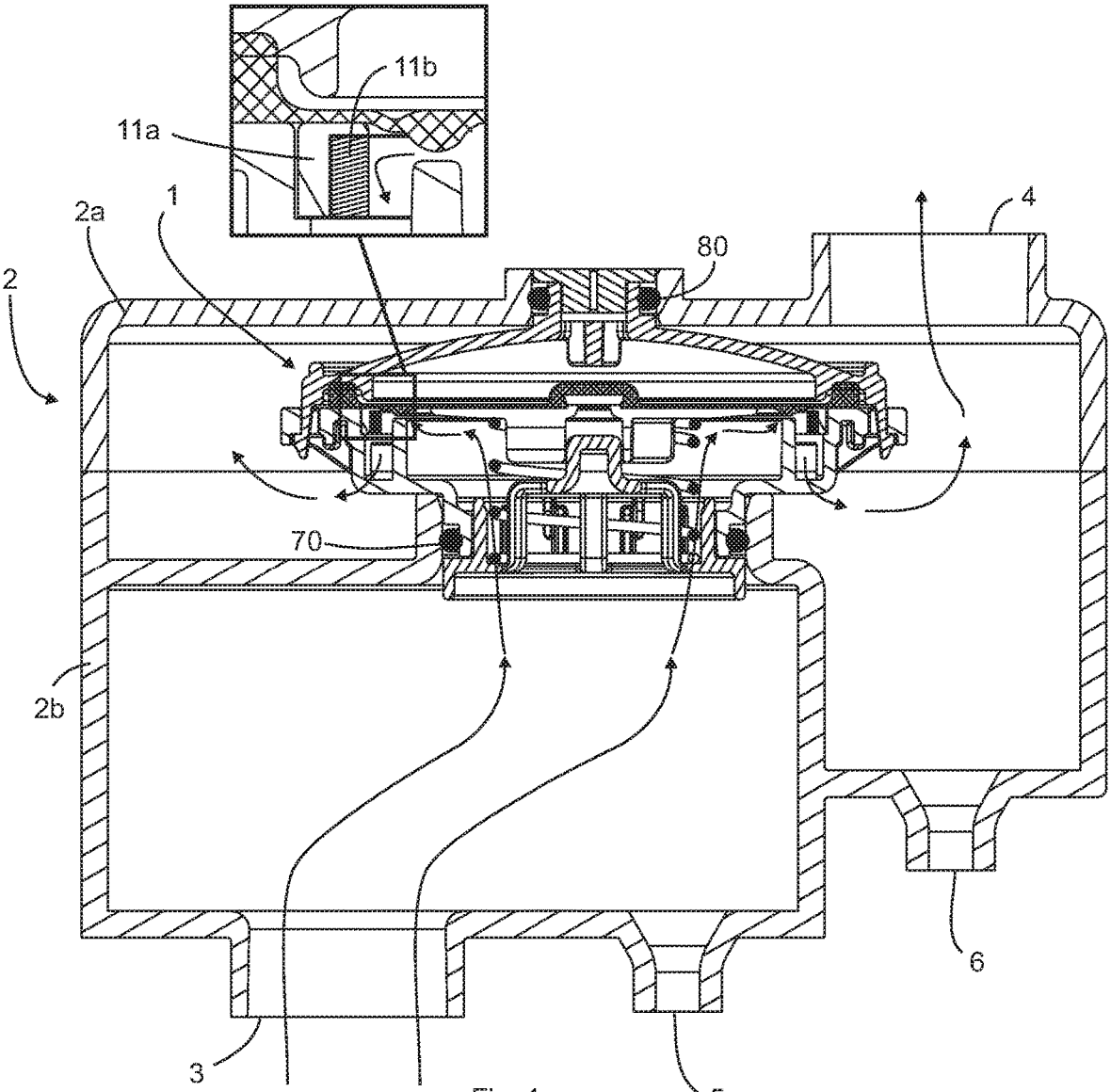

(52) U.S. Cl.
CPC ..... *F01M 2013/0016* (2013.01); *F01M 2013/0044* (2013.01); *F01M 2013/026* (2013.01); *F01M 2013/0433* (2013.01)

(58) Field of Classification Search
USPC ..... 123/41.86, 572–574
See application file for complete search history.

(56) References Cited

U.S. PATENT DOCUMENTS

| | | | | |
|---|---|---|---|---|
| 2010/0294218 | A1* | 11/2010 | Ruppel | F01M 13/021 123/41.86 |
| 2012/0318215 | A1* | 12/2012 | Copley | B01D 45/08 123/41.86 |
| 2014/0026857 | A1* | 1/2014 | Tsutsui | F02M 37/046 123/447 |
| 2014/0165977 | A1* | 6/2014 | Copley | B01D 50/002 123/573 |
| 2017/0014745 | A1* | 1/2017 | Zuerker | B01D 46/002 |
| 2018/0029045 | A1* | 2/2018 | Ishida | B01D 45/12 |
| 2019/0120099 | A1* | 4/2019 | Bock | F01M 13/0011 |

OTHER PUBLICATIONS

Written Opinion and International Search Report of PCT/EP2017/059661, dated Dec. 18, 2017, 13 pages (English and German).

* cited by examiner

OIL-SEPARATING DEVICE

The invention relates to an oil-separating device for cleaning crankcase ventilation gases, having a housing which has a gas inlet, which can be flow-connected to a crankcase, and an outlet, which can be flow-connected to an intake region of an internal combustion engine, and having an oil separator arranged in the housing between the gas inlet and the outlet, a gas duct extending inside the housing and being flow-connected to the gas inlet, an opening on which a plate-shaped throttle diaphragm is arranged being formed at the longitudinal end of the gas duct, said longitudinal end facing away from the gas inlet, and the throttle diaphragm being mounted in the housing such that it can move in the longitudinal direction of the gas duct between a closed position, in which the throttle diaphragm rests on an edge of the opening of the gas duct and closes the opening, and an open position, in which an annular nozzle gap is formed between the edge of the opening and the throttle diaphragm, the gas duct being surrounded at least in some sections by an outlet duct flow-connected to the outlet, and the gas duct and the outlet duct forming an annular gap through which crankcase ventilation gases can flow from the gas duct into the annular gap via the nozzle gap when the throttle diaphragm is in the open position, the oil separator being attached to the outlet duct on the inside of the annular gap and in a flow path, running transversely to the longitudinal direction of the gas duct, of the crankcase ventilation gases flowing through the nozzle gap, and the housing having an additional opening to which a reference pressure can be applied on the side of the throttle diaphragm facing away from the gas duct.

The cleaning of crankcase ventilation gases involves the phase separation of a disperse phase in the form of small oil droplets in the order of magnitude of 1 μm and below, which are distributed in the gaseous phase of the ventilation gas. This physical process of phase separation is referred to as oil separation, for which a continuous supply of energy (power supply) is required. Any passively operated oil separator withdraws a certain proportion of the available power from the crankcase ventilation system in the form of a pressure loss, which results for example from flowing through the pores of a filter or flowing through a cyclone. The more power the oil separator takes up, the greater the potential for a high degree of oil separation. However, the available power in the crankcase ventilation system is limited and also varies greatly depending on the engine operating state.

For oil separation, different designs of oil separators are known, in particular in the automotive field, which are divided within the context of the invention into regulated and unregulated oil separators according to the embodiments below.

Unregulated oil separators within the context of the invention do not have a control loop with controlled and manipulated variables for variably adjusting the pressure loss. The ventilation gases flow through an unregulated oil separator, which at a certain volumetric flow rate always has the same pressure loss which rises continuously as the volumetric flow rate rises, according to an oil-separator-specific pressure loss characteristic curve. The crankcase pressure of an internal combustion engine varies and results from the pressure loss, depending on the ventilation volumetric flow rate, of the oil separator and the negative intake pipe pressure (negative intake (pipe) pressure−pressure loss=crankcase pressure; the available negative intake pressure corresponds only approximately to the negative intake pipe pressure if no additional vacuum generator is interposed).

According to legal requirements and engine manufacturers' specifications, impermissible crankcase overpressures must not arise. Since the crankcase pressure depends on the input variables of intake pipe pressure and oil separator pressure loss, the oil separator pressure loss must be kept very low in the case of unregulated oil separators so that the crankcase pressure is kept in the negative pressure range as far as possible, even in engine operating states in which only a very low negative intake pipe pressure is available (high load, low engine speed). In contrast, in engine operating states in which high negative intake pipe pressures are available and only low ventilation gas volumetric flow rates are present (low load, high engine speed), a higher pressure loss of the oil separator would be advantageous, to use the available power (negative intake pipe pressure×blow-by volumetric flow rate=available power) for the oil separation. Since the pressure loss characteristic curve of an unregulated oil separator is designed for low pressure losses and cannot change, only a very small proportion of the higher available powers in certain engine operating states can be used for oil separation, depending on the engine.

With the previously known unregulated oil separators (unswitched or switched cyclone separators, Polyswirl®, impactors and others), only a small fraction of the available power can be used for oil separation, in particular at higher engine speeds, depending on the engine, although for effective separation of the oil input, which increases with increasing engine speed and load, a higher power uptake proportion would be necessary to prevent an increase in oil consumption.

Previous unregulated oil separators make an additional negative pressure limiting valve ("pressure regulation valve") necessary when the power present in the crankcase depending on the engine design is much higher than the power used by the unregulated oil separator and the unused power would result in an impermissibly high negative crankcase pressure.

Furthermore, unregulated oil separators cannot adjust their pressure loss automatically to varying conditions (negative intake (pipe) pressure, volumetric flow rate).

To clean crankcase ventilation gases contaminated with oil particles, unregulated oil separators which separate some of the oil particles in the form of an oil mist have previously been used for series applications. These unregulated oil separators are partially based on the principle of inertia, with which, as a result of a sudden deflection of the crankcase ventilation gases, for example inside a cyclone, the oil mist particles can no longer follow the flow and are thrown out. Furthermore, oil separators are known which are based on the principle of a diffusion separator. An oil separator which is based both on the principle of a diffusion separator and on the principle of an inertial separator is known from DE 37 015 87 C1. In this oil separator, a filter consisting of a synthetic nonwoven material or metal mesh and based on the diffusion separator principle is arranged upstream of a cyclone as an inertial separator.

With filters through which only flow passes, however, there is the risk that they can accumulate dirt over time and therefore are not maintenance-free, as is generally known for engine oil filters of internal combustion engines. After the crankcase ventilation gas flows out of the cyclone, it flows through a negative pressure limiting valve, which is also referred to as a pressure regulation valve. The need for negative pressure limiting valves is a characteristic disadvantage of unregulated oil separators. Since unregulated oil separators can use only a small proportion of the available crankcase ventilation power in most engine operating states, the excess power must be reduced by the additional flow resistance of a negative pressure limiting valve. Without such a negative pressure limiting valve, the excess power in unregulated oil separators can, depending on the engine and the design of the oil separator, result in an impermissibly high negative crankcase pressure, as a result of which seals and pressure-sensitive components can be overloaded.

A development of an unregulated oil separator is described in EP 2 052 136 B1. With this oil separator, to increase efficiency, multiple smaller through-flow tubes at which the flow arrives tangentially are connected in parallel, some of which are equipped on the gas outlet side with a valve which opens depending on the flow pressure. By the parallel addition of further through-flow tubes, the high flow speed needed for oil separation according to the principle of inertia can be kept at an approximately consistent level in the through-flow tubes over a relatively large volumetric flow rate range, resulting in a correspondingly consistently high degree of oil separation. Even if the pressure loss can be limited or the increase thereof can be reduced by adding further through-flow tubes, this switched oil separator is not a regulated oil separator in terms of regulation technology, since the addition of additional through-flow tubes depends directly on the volumetric flow rate and the resulting flow pressure at the valve.

To solve the problem of full utilisation of the available power in the crankcase ventilation system for oil separation, even when ventilation volumetric flow rates and negative intake pipe pressures vary independently of each other (available power in the crankcase ventilation system=negative intake pipe pressure×blow-by volumetric flow rate), DE 44 04 709 C1 discloses a regulated liquid separator which is based on a cyclone, the tangential inlet cross-section of which can be varied in width by means of a pneumatic adjustment device consisting of a pressure chamber and an actuating member. The disadvantage of this system is the technical complexity for ensuring the intended function. The actuating member is driven by a separate pressure chamber and must additionally be sealed off from the inner wall via elastically resilient inflow faces and outflow faces. Additionally, the actuating member must pass through the wall to the tangential inlet opening in a gastight manner. However, such a gastight design requires very small tolerances and thus at the same time increases the risk of friction increasing up to complete blockage and the function no longer being ensured if there are small interfering influences caused for example by dirt, component warping or thermal expansion differences.

DE 11 2007 003 054 B4 describes a gas-liquid separator for separating oil out of crankcase ventilation gases of an internal combustion engine, which likewise has a pressure chamber which operates an actuator disc. The actuator disc moves transversely to the flow direction and opens different flow cross-sections depending on the pressure difference between the crankcase pressure and atmospheric pressure. The disadvantage of this oil separator regulated by the differential pressure is that the actuator disc must be pulled via a face in the interior of the housing and in the process a static and dynamic friction must be overcome which depends not only on the surface properties but also on the force acting on the actuator disc, said force increasing at higher pressure loss as a result of reduced flow cross-sections. The friction results in a regulation hysteresis (smaller lift of the actuator), as a result of which the regulation range is reduced.

An oil-separating device of the type described in the introduction is also known from DE 10 2014 223 291 A1. In this oil-separating device, an individual impactor is used, the poppet valve of which is connected to a diaphragm which is in contact with the crankcase gases on the inside and is preferably exposed to atmospheric ambient pressure as a reference pressure on the outside. This results in a regulation which reduces the opening cross-section of the oil separator when the power of an eductor pump is increased (and consequently the negative intake pressure generated is higher), so that the pressure difference at the oil separator can increase and thus the oil separation is improved. In this case, the regulation is not adversely affected by the friction forces arising during operation or sealing problems. However, the disadvantage of this oil-separating device is that the regulation range is limited because a portion of the volumetric flow always flows through continuously open through-openings in all three described working regions of the oil-separating device. These continuously open through-openings are formed in a wall of a cylinder through which the blow-by gas flows in the direction of the impactor. The poppet valve is arranged at the head end of the cylinder, it being mounted such that it can move in the longitudinal direction of the cylinder in order either to seal off the head end of the cylinder so that the blow-by gas flows only through the continuously open through-openings or to be lifted off the head end in order to open an additional cross-section to the cross-section formed by the continuously open through-openings. In this case, atmospheric pressure is applied as the reference pressure to the closure plate as the regulator. The disadvantage of this is that the regulation range restricted by the continuously open through-openings can, if the crankcase ventilation gas volumetric flow rate is very low or absent, lead to the pressure loss of the continuously open through-openings being insufficient or no pressure loss at all being generated and an impermissibly high proportion or all of the negative intake pressure being transferred into the crankcase. This risk exists in particular if the outlet of this separator were connected via a line to the intake region in particular of a petrol engine downstream of the throttle valve or to a very powerful vacuum generator. In such a case, an additional negative pressure limiting valve, which would reduce the available power at the separator for the oil mist separation, would be necessary. In addition, at high negative intake pressures, the diaphragm connected to the poppet valve is exposed to correspondingly high forces, which can lead to overloading of the diaphragm when atmospheric pressure is applied as the reference pressure on the side facing away from the crankcase gases for regulation. Even if a positive pressure in the crankcase should be avoided via the oil-separating device, the closure plate with the attached diaphragm and application of atmospheric pressure will only lift off and open at higher pressures than atmospheric pressure (that is, positive pressures in the crankcase). The necessary positive pressure for lifting off and opening the closure plate increases as the negative intake pressure increases and is additionally increased by the spring forces of the spring acting in the closing direction. Since the through-openings continuously open a through-flow cross-section, complete regulation of the entire through-flow cross-section does not in fact take place.

Furthermore, a regulated separator having an unlimited regulation range is known from EP 2 531 273 B1. The regulation of this oil separator is based on a diaphragm which can move along the longitudinal axis via a cylindrical tube. The diaphragm in the form of a rolling diaphragm can, as it moves, cover or expose one or more through-flow openings in the form of slots in the longitudinal direction, the through-flow openings being formed in the wall of the cylindrical tube and leading to the impact face on the inner wall of an outer tube. The fact that the diaphragm in the form of a rolling diaphragm is exposed to the forces resulting from the pressure difference between the negative intake pressure and the crankcase pressure only in the region of the slots allows the mechanical loading of the diaphragm material to be kept low. In addition, the force resulting from the pressure difference between the negative intake pressure and the crankcase pressure runs transversely to the movement direction of the diaphragm, and therefore this force does not negatively influence the regulation. However, the space required for this oil separator is comparatively large. A further disadvantage of such an oil separator consists in that the rolling diaphragm can crease or unroll incorrectly, and as generally known for rolling diaphragms, the pressure gradient may only act in one direction, otherwise there is the risk of the rolling diaphragm turning inside out, which can occur for example during leak-testing of the oil separator with a positive pressure.

The invention addresses the problem of creating a solution which provides an oil-separating device of simple design, with which good oil separation can be achieved even with varying pressures and varying ventilation gas volumetric flow rates.

With an oil-separating device of the type mentioned in the introduction, the problem is solved according to the invention in that the throttle diaphragm is designed to extend radially beyond the annular gap and has a sealing region moulded onto the edge, said sealing region being sealingly arranged in a recess formed in the housing such that the throttle diaphragm fluidically separates the additional opening from the gas inlet.

Advantageous and expedient configurations and developments of the invention can be found in the dependent claims.

The invention provides an oil-separating device for cleaning crankcase ventilation gases, said device having a design suitable for the function and a simple and cost-effective structure. Advantageously, the oil-separating device according to the invention does not need a pressure regulation valve, unlike unregulated oil-separating devices according to the generally known prior art (see for example Handbuch Verbrennungsmotor, Vieweg+Teubner Verlag, 2002 edition, page 144, FIG. 7-78), and therefore the number of components and production costs are reduced in comparison with unregulated oil-separating devices. The omission of a pressure regulation valve also has an advantageous effect on the simplification of the design (for example for the cylinder head cover) and the outlay on assembly. The regulated oil-separating device according to the invention adapts automatically to chronologically varying conditions and avoids overpressures in critical characteristic map ranges despite maximum utilisation of the power in all characteristic map ranges. The oil-separating device according to the invention also has fewer mechanically moving components, which are furthermore subject to lower tolerance requirements, than known oil-separating devices. In contrast to oil-separating devices with a rolling diaphragm, no static or dynamic friction forces prevail in the oil-separating device according to the invention during adjustment of the throttle diaphragm or the cross-section of the nozzle gap, since the change in the cross-section of the nozzle gap takes place by a contact-free change in the distance between the circumferential shoulder of the throttle diaphragm and the edge of the opening of the gas duct. Contact and the necessary sealing between a circumferential shoulder of the throttle diaphragm and the edge of the opening of the gas duct take place only if there is a negative intake pressure and at the same time no crankcase ventilation gas volumetric flow is generated by the engine, as described in more detail below. The oil-separating device according to the invention for cleaning crankcase ventilation gases has the throttle diaphragm in addition to the inertial separator for regulated oil separation. The housing of the oil-separating device has the gas inlet, which can be flow-connected to the crankcase so that gas contaminated by oil particles flows through the gas inlet into the housing of the oil-separating device. The oil-separating device also has an outlet, which can be connected to an intake region of an internal combustion engine such as an intake pipe. Oil discharge or oil recirculation preferably takes place via a separate further outlet or a branch of the outlet. Preferably, the separated-out oil is recirculated into the crankcase.

An oil separator is arranged in front of the outlet in the flow direction of the crankcase ventilation gas. This oil separator preferably has a functional face effective for separation, preferably a textile, in particular for separating out fine oil droplets. However, an oil separator which operates solely or additionally according to the principle of inertial oil separation, such as a cyclone, could also be provided as the oil separator.

A throttle diaphragm is arranged in front of the oil separator as seen in the flow direction. Depending on the operating state, the throttle diaphragm can form a nozzle-like throttle opening or nozzle gap, the nozzle gap preferably being an annular gap between the edge of the opening of the gas duct. Alternatively, the throttle diaphragm could also form multiple individual openings, slots or the like when it is in the open position. According to the invention, the through-flow cross-section of the nozzle gap is variable, i.e. a correspondingly dimensioned nozzle gap is produced depending on the engine operating state.

According to the invention, the throttle diaphragm is mounted such that its position can be changed or varied. The through-flow cross-section of the nozzle gap can be varied by changing the position of the throttle diaphragm. Accordingly, the throttle diaphragm is designed such that it is mounted movably in the flow direction of the gas-oil mixture flowing into the housing through the gas inlet. In this case, the flow direction corresponds to the longitudinal direction of the gas duct into which the gas-oil mixture flows into the housing. The through-flow cross-section of the nozzle gap is varied by such a movement of the throttle diaphragm. Owing to the movement in the flow direction, the oil-separating device according to the invention has the advantage that, for example, friction occurring during displacement of the throttle diaphragm is virtually not present at all, and if minimal friction forces occur, they remain at a constant level independently of the pressure difference between the intake pressure and the crankcase pressure. The forces caused by pressure differences of the flowing gas-oil mixture in combination with the forces caused by the intake pipe act in or counter to the movement direction of the throttle diaphragm and cause no change in the friction occurring, in contrast to forces acting perpendicularly or at an angle in relation to the movement direction of the throttle diaphragm.

In the design of the invention, the throttle diaphragm is rotationally symmetrical, it being preferred for the axis of symmetry of the throttle diaphragm to run in the axial direction, i.e. in the main flow direction of the inflowing gas. Alternatively, the throttle diaphragm could also be asymmetrical.

Furthermore, it is preferred for the throttle diaphragm to be substantially plate-shaped.

Independently of the design of the throttle body, it is preferred for the flow direction of the gas-oil mixture to run axially or parallel to the movement direction of the throttle diaphragm in the gas inlet. In this case, flow passes through the nozzle gap uniformly around its perimeter in a radial direction to the throttle diaphragm. Owing to the preferred nozzle gap running uniformly around the perimeter, the radial forces on the throttle diaphragm cancel each other out. As a result, transverse forces on the throttle diaphragm and the associated friction forces on an inner side of the housing or a guide rail are avoided.

Since atmospheric pressure should prevail on the side or side face of the throttle diaphragm facing away from the gas duct, the housing has an additional opening to which atmospheric pressure is applied or which is connected to a region in which atmospheric pressure prevails. In particular, the additional opening can be connected to the environment.

It is also possible for an additional negative pressure to be generated downstream of the oil separator. This can be done in that the outlet is connected to a vacuum generator or that negative pressure is generated in this region by a vacuum generator. For example, an eductor pump can be provided as a suitable vacuum generator. This makes it possible to increase the power uptake of the oil-separating device beyond the power available depending on the engine design for the benefit of complete or improved oil separation.

To separate out the oil passing through the nozzle gap, an oil separator operating according to the principle of inertia and/or the principle of diffusion is arranged downstream of the throttle gap in the flow direction. A filter element can be provided as the diffusion separator; the filter element can be annular or strip-shaped.

In one embodiment of the invention, the throttle diaphragm has a circumferential shoulder which is formed on the side of the throttle diaphragm facing the gas duct and rests on the edge of the opening of the gas duct when the throttle diaphragm is in the closed position, the nozzle gap being formed between the edge of the opening and the circumferential shoulder of the throttle diaphragm when the throttle diaphragm is in the open position. The shoulder is therefore a defined contour which is in contact with the edge of the opening and prevents crankcase ventilation gases flowing in the direction of the outlet when the throttle diaphragm is in the closed position.

It is particularly advantageous in an embodiment of the invention if there is between the sealing region and the edge of the opening, as seen in the radial direction, a circumferential throttle diaphragm supporting face, on which a circumferential and elastically deformable diaphragm flexing region of the throttle diaphragm, which is rotationally symmetrical, rests in a supported manner, at least in the closed position. Since the throttle diaphragm extends radially outwards beyond the annular gap in relation to the gas duct or the outlet duct, at least the section of the throttle diaphragm which extends over the annular gap is normally exposed to a negative intake pressure which is generated at the outlet and would pull this section of the throttle diaphragm in the direction of the outlet or in the direction of the closed position of the throttle diaphragm, as a result of which the nozzle gap could be made smaller. The negative intake pressure at the outlet is therefore a disturbance variable which impairs the regulation behaviour of the throttle diaphragm. The throttle diaphragm supporting face counteracts this, since it supports the diaphragm flexing region which is at least one flexible region of the throttle diaphragm which allows a movement of the throttle diaphragm between the closed position into different open positions, in the direction of the outlet. When the throttle diaphragm is in the closed position, the diaphragm flexing region rests completely rolled up or flexed up on the throttle diaphragm supporting face, but when the throttle diaphragm moves out of the closed position into an open position, the diaphragm flexing region peels off, in a manner of speaking.

In a preferred embodiment, the throttle diaphragm supporting face extends radially inwards as far as the circumferential shoulder of the throttle diaphragm. This preferred embodiment has the advantage that a degree of design freedom results which makes it possible to adjust the radial distance of the oil separator from the nozzle gap independently of the inner diameter of the throttle diaphragm supporting face in design terms. This makes it possible to make the distance of the impact face or the separation-effective functional face of the oil separator from the nozzle gap greater than the radial distance of the inner diameter of the throttle diaphragm supporting face 31, in order on the one hand to be able to select the optimal distance for oil mist particle separation of the impact face or the separation-effective functional face of the oil separator from the nozzle gap and on the other hand, independently of this, to keep the force application face for the negative intake pressure, which lies substantially between the inner diameter of the throttle diaphragm supporting face and the circumferential shoulder, as small as possible for the benefit of the optimal regulation behaviour.

The atmospheric pressure on the side of the throttle diaphragm facing away from the gas duct acts as a reference pressure to the order of magnitude of which the crankcase pressure should be adjusted. To achieve this, according to a further embodiment of the invention, the nozzle gap is arranged on a diameter, in relation to the throttle diaphragm, which is at most 15% smaller than an inner diameter of the throttle diaphragm supporting face. This results in effective force application faces for the atmospheric pressure on the side, facing away from the gas duct, of the throttle diaphragm which faces the gas duct, and on the side of the throttle diaphragm 10 which faces the crankcase pressure. By dimensioning the side of the throttle diaphragm to which crankcase pressure is applied to an area approximately of the side of the throttle diaphragm to which atmospheric pressure is applied, the remaining annular face between the throttle diaphragm supporting face and the nozzle gap is correspondingly small. This has the advantage that only a small annular force application face of the diaphragm is exposed to the negative intake pressure generated at the outlet.

It is particularly favourable in design terms, with regard to a compact design, if, in one embodiment of the invention, the throttle diaphragm supporting face is in the form of a first flange of a profiled element, a second flange forming a direct impact face of the oil separator or acting as an attachment face for a separation-effective functional face. Consequently, the oil separator and the throttle diaphragm supporting face are provided as an integral and annular component, as a result of which the assembly of the modularly constructed oil-separating device is made easier.

In one embodiment of the invention, the inner diameter of the throttle diaphragm supporting face is smaller than the inner diameter of the impact face and is smaller than the inner diameter of the separation-effective functional face.

It has proven favourable in terms of good and stable regulation behaviour for the layout and dimensioning of the oil-separating device that the diameter of the nozzle gap is only at most 15% smaller than the inner diameter of the diaphragm flexing region supporting face.

A possibility of simple and compact design for attaching the oil separator consists in that the annular gap has at least one bearing face on which the oil separator is held, resting thereon.

In a further embodiment of the invention, the throttle diaphragm is mounted on the housing such that it can move in the direction of the closed position, counter to the force of an elastic spring element in the opening direction, the elastic spring element being supported both on the housing and on the side of the throttle diaphragm facing the gas duct. In other words, the spring element acts on the throttle diaphragm in the opening direction, a minimal nozzle gap being set by the spring element when the internal combustion engine is switched off, without any pressure differences at the plate-shaped throttle diaphragm and without any crankcase ventilation gas volumetric flow, so that a predefined distance is set between the edge of the opening of the gas duct and the circumferential shoulder of the throttle diaphragm by the spring element.

In a further embodiment of the invention, the separation of oil out of the crankcase ventilation gases can be promoted if the oil separator has a separation-effective functional face, in particular that of a nonwoven material or a textile.

Finally, one embodiment of the invention provides for the outlet to be flow-connected to a vacuum generator, in particular an eductor pump. A vacuum generator in the form of an eductor pump operates with fluid-dynamic forces and functions without an external mechanical drive such as a motor, belt drive or the like.

In another embodiment of the invention, it is advantageous if the reference pressure on the side of the throttle diaphragm facing away from the gas duct is atmospheric pressure.

It is likewise advantageous if the oil-separating device is in the form of a modular functional assembly. In this case, it is advantageous if the oil-separating device in the form of a modular functional assembly is used in a crankcase ventilation gas conducting housing element and the spatially gastight separation of contaminated from cleaned crankcase ventilation gases and of cleaned crankcase ventilation gases from ambient air at atmospheric pressure level takes place by means of seals or a gastight weld.

Finally, it is preferred if the perimeter of the circumferential nozzle gap and/or the housing has substantially a circular or oval or angular contour.

The oil-separating device according to the invention is in summary a regulated oil-separating device. With said device, a proportion of up to 100% of the available power in the crankcase and additional power from a vacuum generator can be used. This is possible over the entire engine characteristic map, and therefore an increase in the degree of oil separation is made possible, since the regulated oil separator adapts to the varying engine operating conditions. An additional negative pressure limiting valve is therefore no longer necessary. The design is therefore much simpler.

In the context of the invention, the term "duct" can be regarded as a synonym for the expression "pipe", which means an elongate hollow body, the cross-section of which does not necessarily have to be circular but can also have a rectangular, oval or other cross-section. Furthermore, the expression "circumferential" means an element which runs around radially and can for example be annular.

Figure 2:
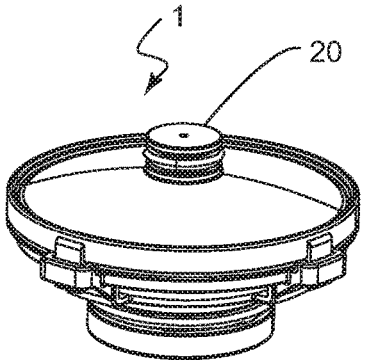
Figure 3:
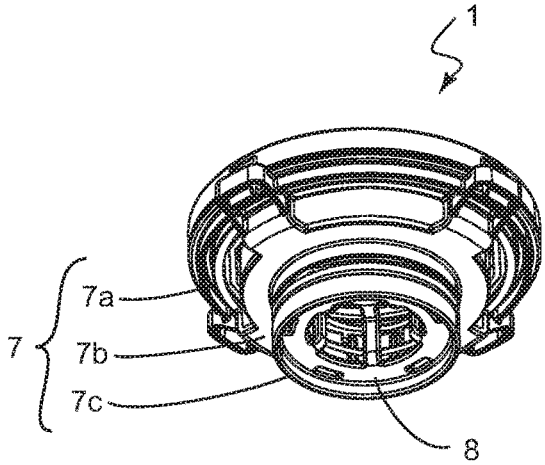
Figure 4:
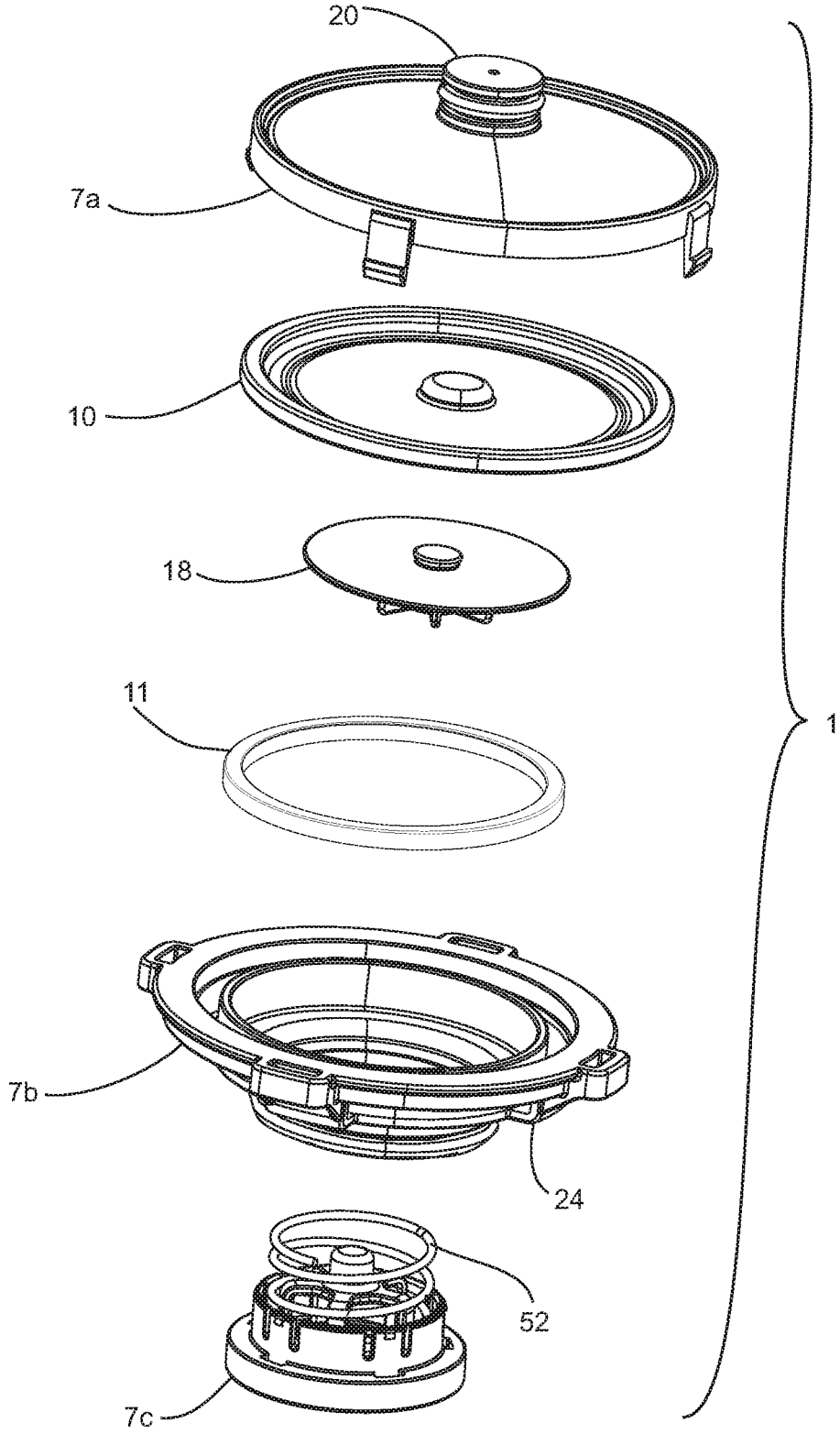
Figure 5:
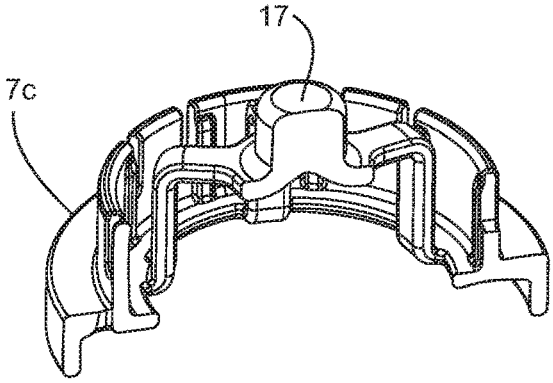
Figure 6:
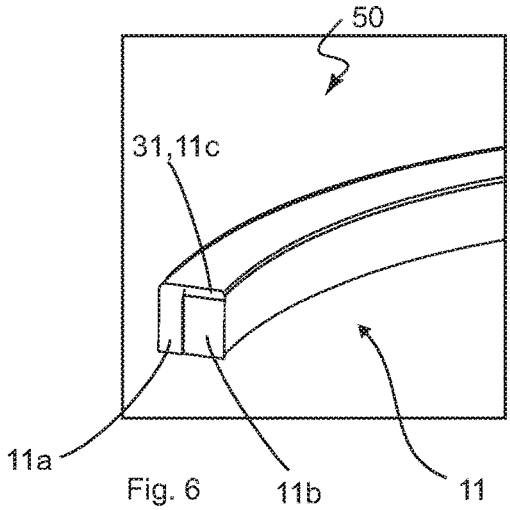
Figure 7:
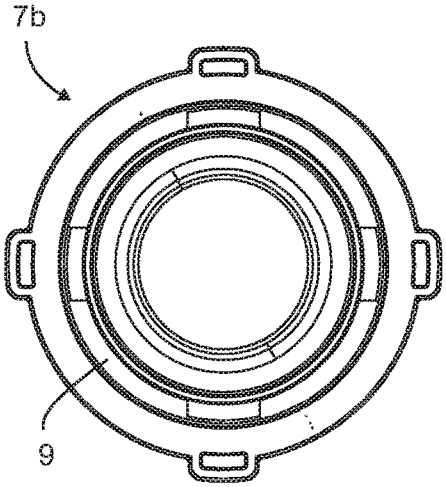
Figure 8:
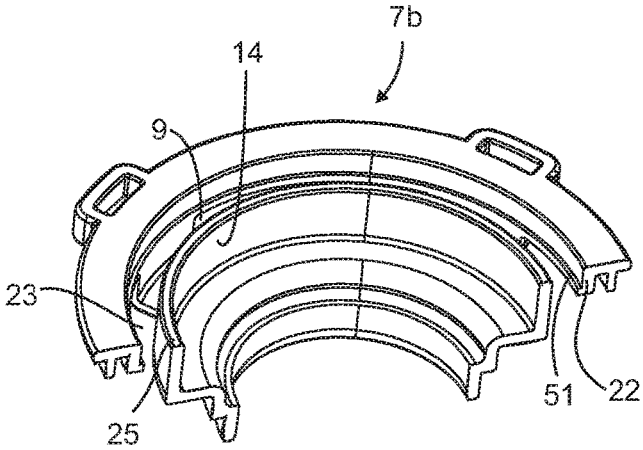
Figure 9:
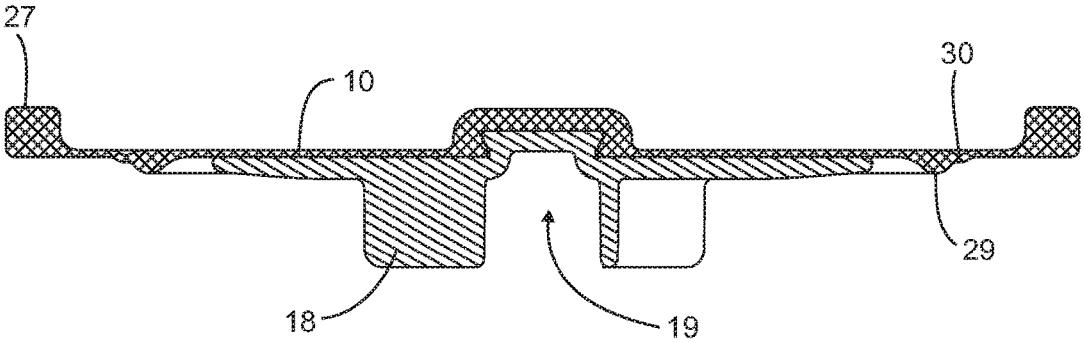
Figure 10:
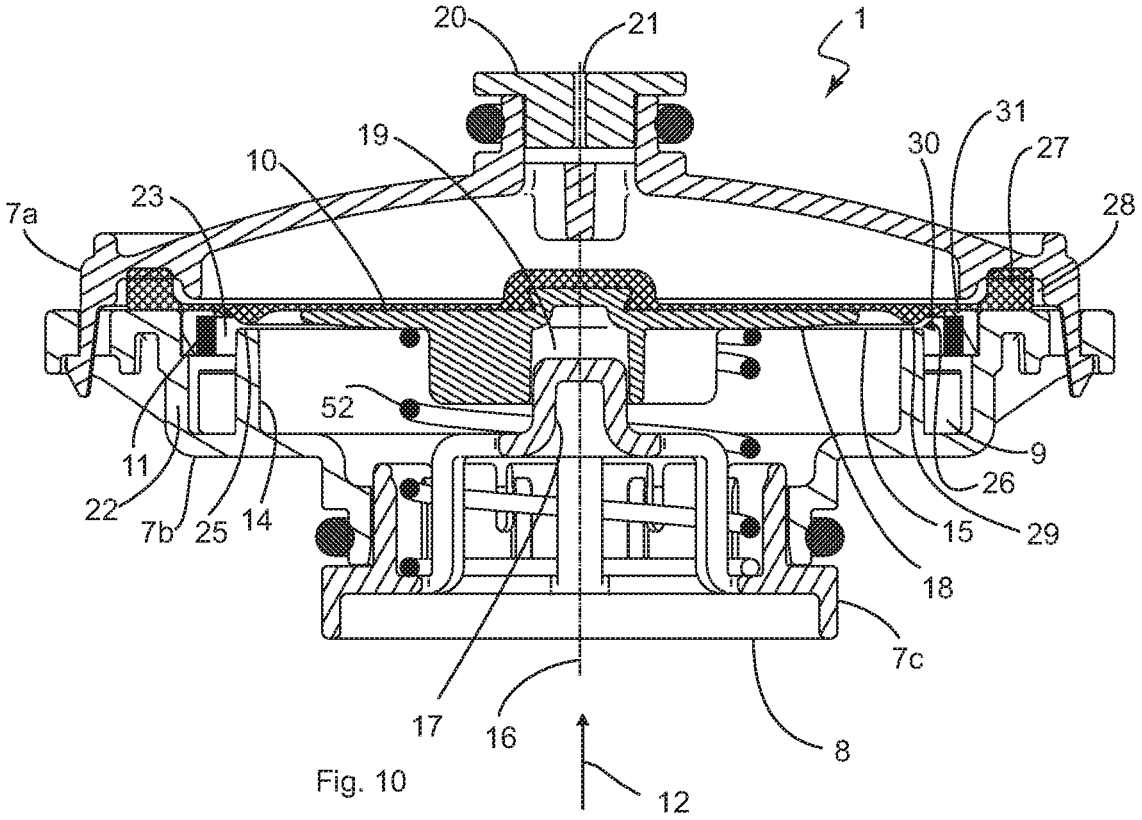
Figure 11:
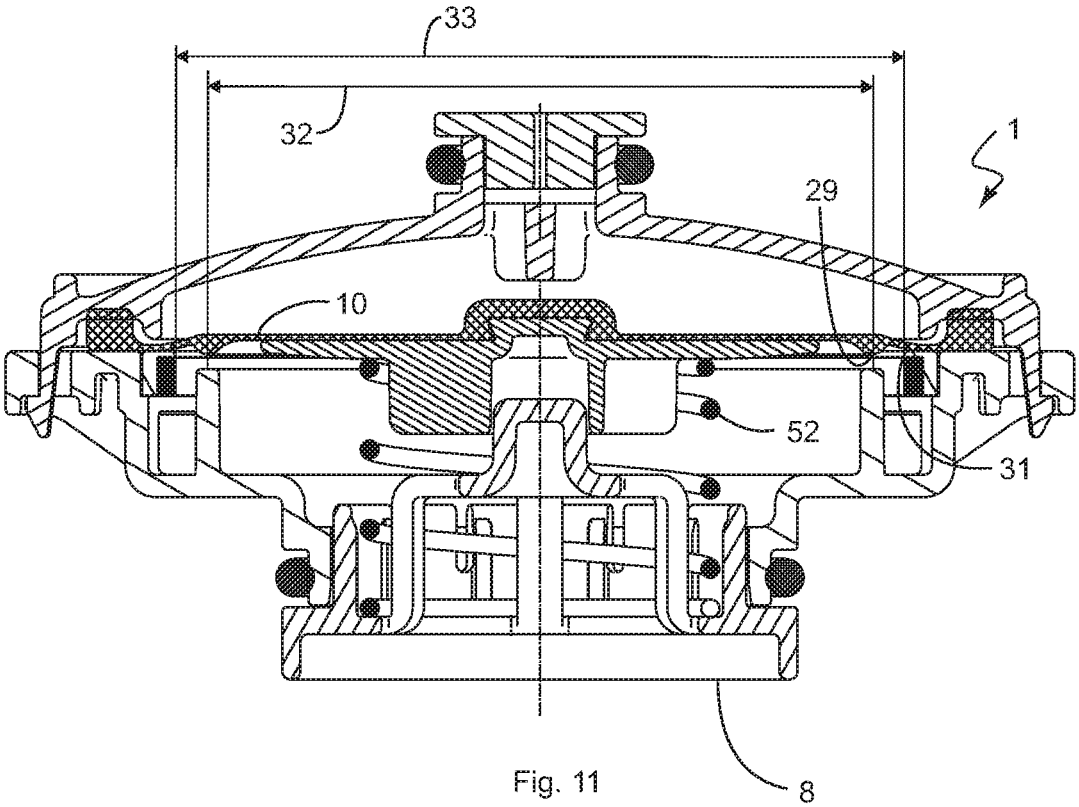
Figure 12:
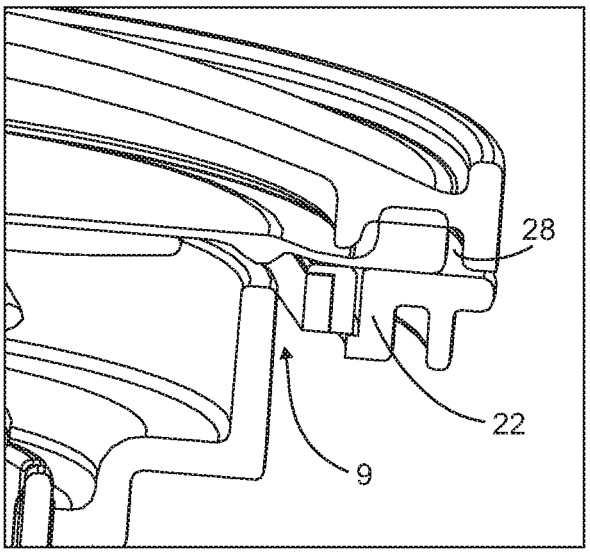
Figure 13:
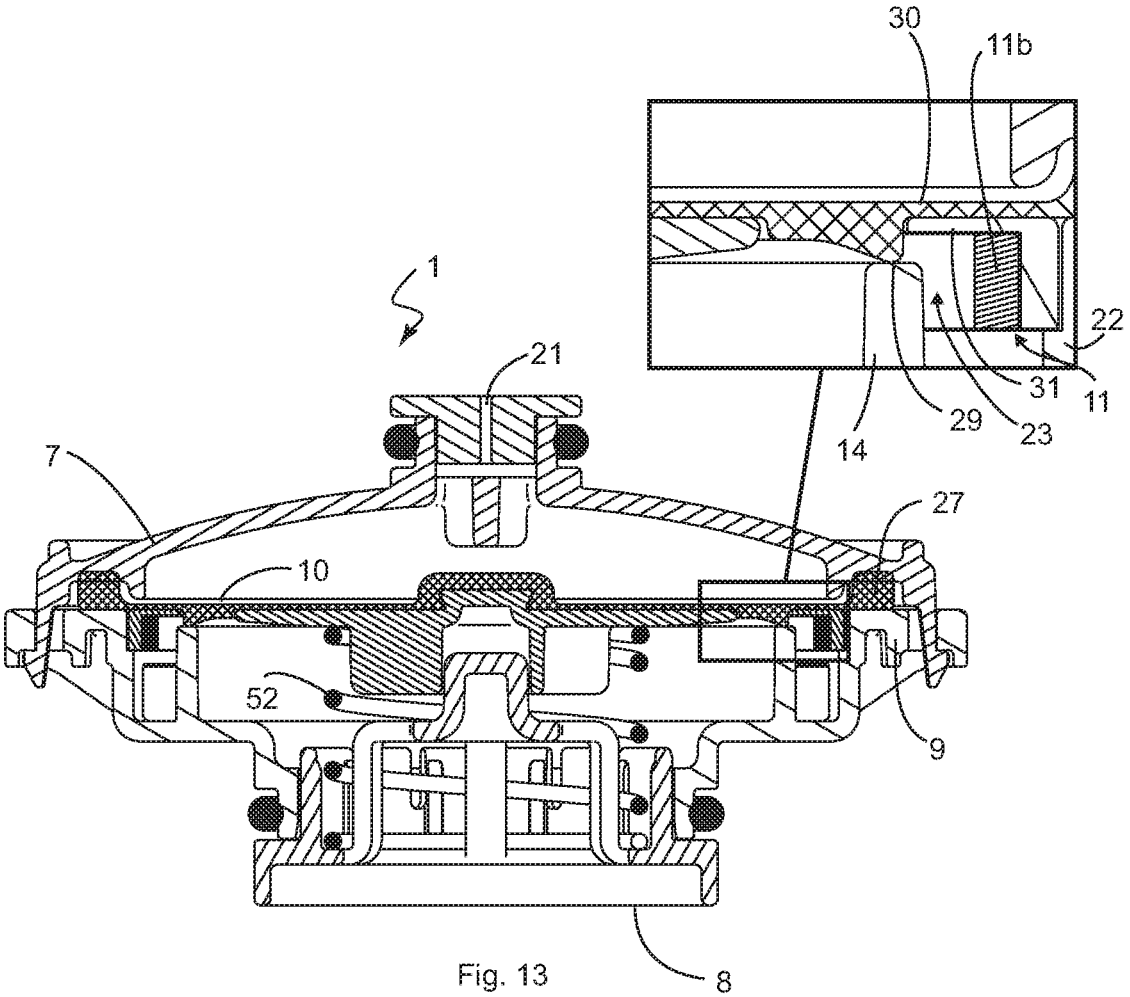
Figure 14:
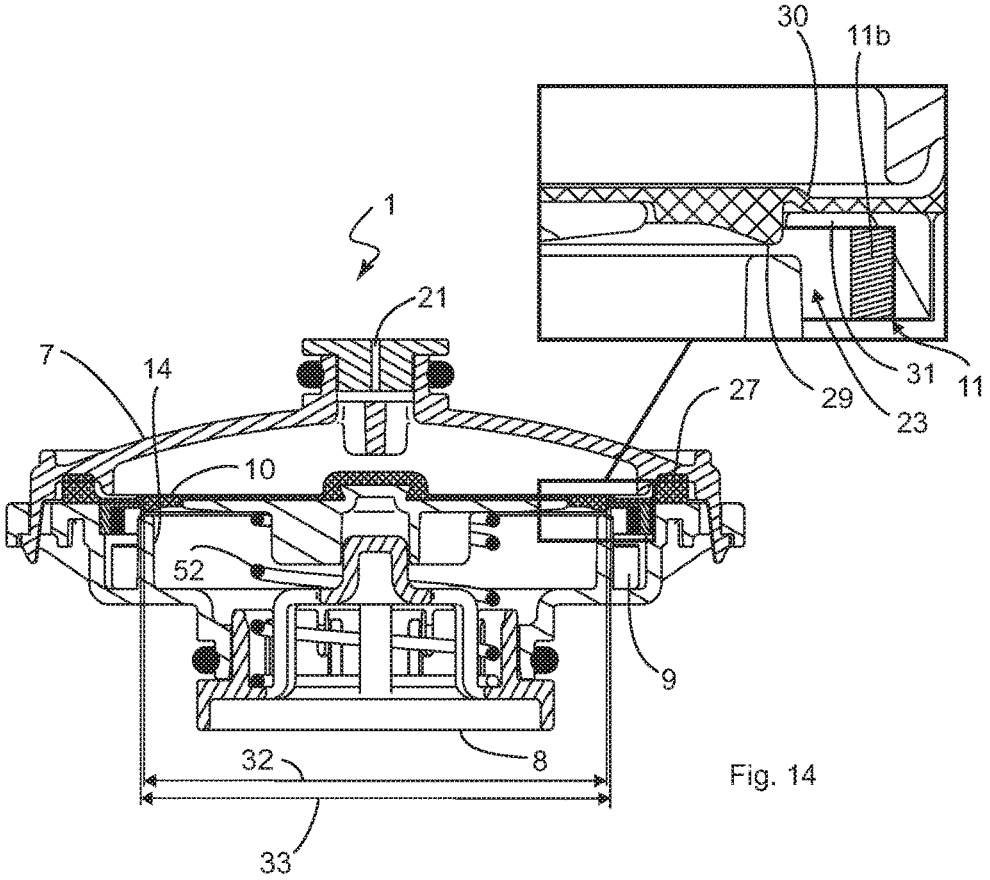
Figure 15:
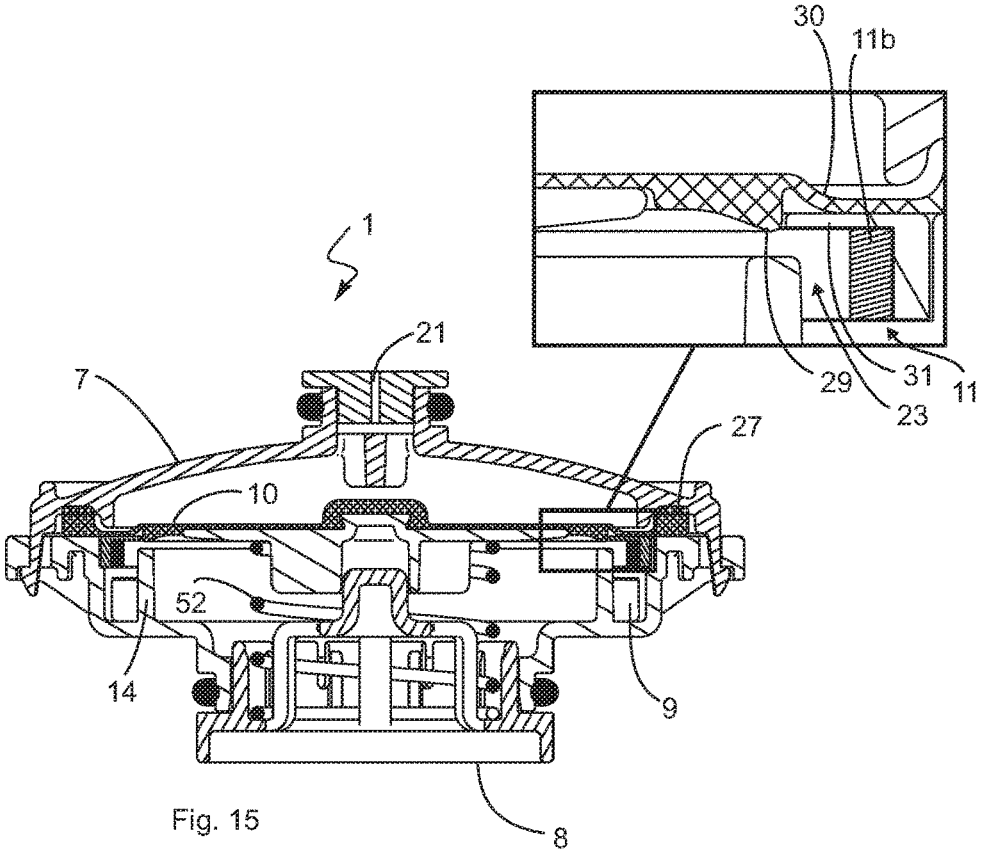

Further details, features and advantages of the subject matter of the invention can be found in the description below in conjunction with the drawing, in which preferred exemplary embodiments of the invention are shown by way of example. In the drawing:

FIG. 1 shows a sectional view of an oil-separating device according to the invention, which is installed in a cylinder head cover, FIG. 2 shows a perspective view of the oil-separating device according to the invention from above, FIG. 3 shows a perspective view of the oil-separating device according to the invention from below, FIG. 4 shows a perspective diagram of individual parts of the oil-separating device according to the invention, FIG. 5 shows a perspective sectional view of an inflow cylinder of the oil-separating device according to the invention, FIG. 6 shows a detailed sectional view of an oil separator of the oil-separating device according to the invention, FIG. 7 shows a view of a lower housing part of the oil-separating device according to the invention from above, FIG. 8 shows a perspective sectional view of the lower housing part of the oil-separating device according to the invention, FIG. 9 shows a lateral sectional view of a throttle diaphragm and a supporting plate of the oil-separating device according to the invention, FIG. 10 shows a lateral sectional view of the oil-separating device according to the invention with the nozzle gap slightly open, FIG. 11 shows a lateral sectional view of the oil-separating device according to the invention with the nozzle gap more open, FIG. 12 shows a detailed sectional view of selected components of the oil-separating device according to the invention, FIG. 13 shows a lateral sectional view of an alternative embodiment of an oil-separating device according to the invention with the nozzle gap closed, FIG. 14 shows a lateral sectional view of the alternative embodiment of the oil-separating device according to the invention with the nozzle gap open, and FIG. 15 shows a lateral sectional view of the alternative embodiment of the oil-separating device according to the invention with the nozzle gap maximally open.

FIG. 1 shows a sectional view in which an oil-separating device 1 according to the invention for cleaning crankcase ventilation gases is integrated by way of example in a two-shelled housing element 2 having an upper housing part 2*a* and a lower housing part 2*b*. This exemplary installation diagram is intended to demonstrate that the oil-separating device 1 according to the invention can be integrated very easily into a housing such as a cylinder head cover. Via a crankcase ventilation gas inlet 3, crankcase ventilation gas to be cleaned passes to the oil-separating device 1, through which the crankcase ventilation gas laden oil mist particles flows, as shown using the arrows in FIG. 1. After flowing through the oil-separating device 1, the gas flow flows via a crankcase ventilation gas outlet 4 out of the housing element 2, wherein larger and easier to separate oil mist particles can drain out of the housing 2 via a first oil drain 5, whereas fine oil mist particles which are separated out in the oil-separating device 1 can drain out of the housing 2 via a second oil drain 6. To convey the flow through the oil-separating device 1, there is usually an eductor pump (not shown in FIG. 1) at the crankcase ventilation gas outlet 4.

FIGS. 2 and 3 show different perspective views of the oil-separating device 1 according to the invention; FIG. 2 shows a view from above and FIG. 3 shows a view from below. The compact and flat design of the oil-separating device 1 can be seen from these two diagrams, which only show a housing 7 of the oil-separating device 1.

The structure of the oil-separating device 1 according to the invention is explained below using FIGS. 4 to 12. FIG. 4 shows a diagram of individual parts of the oil-separating device 1, which has the housing 7, which comprises a housing cover 7*a*, a lower housing part 7*b* which is in engagement with the housing cover 7*a* via a hook connection, and an inflow cylinder 7*c*. The housing 7 has a gas inlet 8 (see for example FIGS. 3 and 10), which can be flow-connected to a crankcase (see for example FIG. 1) and is formed on the inflow cylinder 7*c*, and an outlet 9 (see for example FIGS. 8 and 12), which can be flow-connected to an intake region of an engine and is formed on the lower housing part 7*b*.

An oil-mist-containing crankcase ventilation gas flows through the gas inlet 8 into the housing 7, the crankcase ventilation gas flowing substantially in the direction of a main flow direction 12 (see FIG. 10). The cleaned gas flows through the outlet 9 out of the housing 7 and then passes into the intake region or intake pipe of the engine, as described for FIG. 1. Inside the housing 7, a throttle diaphragm 10 and an oil separator 11 are arranged inside the housing 7 and between the gas inlet 8 and the outlet 9. The wall of the lower housing part 7*b* forms a gas duct 14 which is flow-connected to the gas inlet 8 and leads to the throttle diaphragm 10. At a longitudinal end of the gas duct 14 remote from the gas inlet 8 there is an opening 15 at which the plate-shaped throttle diaphragm 10 is arranged. The gas duct 14 is surrounded by an outlet duct 22 which is flow-connected to the outlet 9, the gas duct 14 and the outlet duct 22 forming an annular gap 23. The outlet duct 22 is in the form of a ring which runs around the gas duct 14 and is connected to the gas duct 14 via four connecting pieces 24 distributed uniformly around the perimeter of the gas duct 14 and is thus fixed to the lower housing part 7*b*.

The housing 7 or the inflow cylinder 7*c* has a guiding peg 17 which is arranged in the centre of the housing 7 and extends in the longitudinal direction 16 of the gas duct 14. The guiding peg 17 is used to guide and support a supporting plate 18 on which the throttle diaphragm 10 is held resting thereon. The supporting plate 18 has a central opening 19 into which the guiding peg 17 protrudes. By means of the guiding peg 17, a movement of the throttle diaphragm 10 in the longitudinal direction 16 of the gas duct 14 is possible, so that the throttle diaphragm 10 is mounted in the housing 7 such that it can move between a closed position, in which the throttle diaphragm 10 rests on an edge 25 of the opening 15 of the gas duct 14 and closes the opening 15, and an open position, in which an annular nozzle gap 26 is formed between the edge 25 of the opening 15 and the throttle diaphragm 10. In an open position (see for example FIG. 10), in which there is a nozzle gap 26, crankcase ventilation gases can flow from the gas duct 14 via the nozzle gap 26 into the annular gap 23, as shown by way of example in FIG. 1 by the arrows indicating the flow. Furthermore, a throttle aperture 20 which has an additional opening 21 is arranged in the housing cover 7*a*. The additional opening 21 which is consequently formed in the housing 7 is connected to the environment so that atmospheric pressure always prevails inside the housing cover 7*a*. The atmospheric pressure is a reference pressure which is applied from the side of the throttle diaphragm 10 facing away from the gas duct 14. The throttle diaphragm 10 thus separates the additional opening 21 from the gas inlet 8 and the outlet 9 in terms of flow, wherein the plate-shaped throttle diaphragm 10 for this purpose extends radially beyond the annular gap 23 and has a sealing region 27 which is formed running around the edge and is arranged sealingly in a recess 28 formed in the housing 7 or in the lower housing part 7*b* in such a manner that atmospheric pressure is applied to the interior of the housing cover 7*a* and thus the side of the throttle diaphragm 10 facing away from the gas inlet 8.

The throttle diaphragm 10 has a circumferential shoulder 29 which is formed on the side of the throttle diaphragm 10 facing the gas duct 14. When the throttle diaphragm 10 is in the closed position, the circumferential shoulder 29 rests on the edge 25 of the opening 15 of the gas duct 14, and when the throttle diaphragm 10 is in the open position, the nozzle gap 26 is formed between the edge 25 of the opening 15 and the annular shoulder 29 of the throttle diaphragm 10.

In the exemplary embodiment shown, an inertial separator is provided as the oil separator 11. By means of said separator, the gas flow, i.e. the oil-air mixture, is greatly deflected so that the oil is deposited on an inner side of the inertial oil separator 11. In particular, the oil separator 11 has a baffle 11*a*, which in the exemplary embodiment shown has a surface 11*b* which assists oil separation. This can be implemented by surface texturing or by providing a nonwoven material or textile. The oil separator 11 is attached to the outlet duct 22 on the inside of the annular gap 26 and in a flow path, running transversely to the longitudinal direction 16 of the gas duct 14, of the crankcase ventilation gases flowing through the nozzle gap 26. Depending on the pressure prevailing in the crankcase and thus also in a region of the gas inlet 8, the movably mounted throttle diaphragm 10 moves upwards or downwards in the longitudinal direction 16 in FIG. 10 as a result of the prevailing forces and the pressure differences. This causes the diaphragm flexing region 30 (see FIG. 11), which is in the form of a circumferential section offset radially outwards from the annular shoulder 29 on the throttle diaphragm 10, to be lifted or lowered, so that a varying nozzle gap 26 is formed or the annular shoulder 29 rests on the edge of the opening 15, as long as there is a negative intake pressure without a crankcase ventilation gas volumetric flow being created by the engine to prevent the transfer of the negative intake pressure into the crankcase.

In the oil-separating device 1 according to the invention there is also a circumferential throttle diaphragm supporting face 31 between the sealing region 27 and the edge 25 of the opening 15 as seen in the radial direction, on which throttle diaphragm supporting face the annular and elastically deformable diaphragm flexing region 30 of the rotationally symmetrical throttle diaphragm 10 rests in a supported manner, at least in the closed position. The throttle diaphragm supporting face 31 is arranged above the separation-effective functional face 11*b* and the baffle 11*a* and extends radially inwards at most as far as the circumferential shoulder 29 of the throttle diaphragm 10. The thickness of the circumferential shoulder can be designed such that a height offset in the longitudinal direction 16 results in relation to the throttle diaphragm supporting face 31, so that it is ensured that the jet out of the nozzle gap 26 meets the opposite and separation-effective surface 11*b*. The necessary height offset should be matched to the maximum required nozzle gap 26 which results at minimum negative intake pressure and maximum crankcase ventilation gas volumetric flow in the internal combustion engine in question.

Without a throttle diaphragm supporting face 31 for the throttle diaphragm 10, the throttle diaphragm 10 in the diaphragm flexing region 30 would be pulled in the direction of the negative intake pressure (that is, in the direction of the outlet 9) by the pressure difference between atmospheric pressure and the negative intake pressure. A force acts on the throttle diaphragm 10 in the closed position; without an additional counter force in the opening direction, for example from a spring element, said force would result in a nozzle gap 26 which is too small and, as a consequence of that, a crankcase overpressure. The throttle diaphragm supporting face 31 for the throttle diaphragm 10, as a stop face, prevents the throttle diaphragm 10 in the diaphragm flexing region 30 being pulled in the direction of the negative intake pressure. Correspondingly, additional forces in the closing direction of the throttle diaphragm are thereby minimised or avoided completely. As a result, a spring element for applying an additional opening force is not necessary to keep the crankcase pressure at atmospheric pressure level. Preferably, the throttle diaphragm supporting face 31 extends radially inwards as far as the annular shoulder 29 of the throttle diaphragm 10, as shown in FIGS. 13 to 15 for an alternative embodiment of the oil-separating device 1, the alternative embodiment differing from the embodiment of the oil-separating device 1 of FIGS. 1, 10 and 11 by the radially inward extent of the throttle diaphragm supporting face 31 and the shape of the circumferential shoulder 29. For an advantageous design of the oil-separating device 1, it should be ensured that the nozzle gap 26 is arranged at a diameter 32, in relation to the throttle diaphragm 10, which is at most 15% smaller than an inner diameter 33 of the throttle diaphragm supporting face 31 (see for example FIG. 11). The throttle diaphragm supporting face 31 is in the form of a flange 11*c* of a profiled element 50 of L-shaped cross-section, the other flange 11*a* forming the impact face of the oil separator 11. The profiled element 50 rests on at least one bearing face 51 which is formed inside the annular gap 23.

In the exemplary embodiments shown in the drawings, the throttle diaphragm 10 is mounted on the housing 7 such that it can move into the closed position counter to the force of an elastic spring element 52, the elastic spring element 52 being supported both on the housing 7 and on the side of the throttle diaphragm 10 facing the gas duct 14. The spring element 52 acts on the throttle diaphragm 10 in the opening direction, a minimal nozzle gap 23 being set by the spring element 52 when the internal combustion engine is switched off, without any pressure differences at the plate-shaped throttle diaphragm 10 and without any crankcase ventilation gas volumetric flow, so that a predefined distance or nozzle gap 26 is set between the edge 25 of the opening 15 of the gas duct 14 and the annular shoulder 29 of the throttle diaphragm 10 by the spring element 52.

The description of the oil-separating device 1 according to the invention with its design features above is followed by a description of the function of the oil-separating device 1.

In the oil-separating device 1 shown in FIGS. 1, 10, 11 and 13 to 15, the oil-mist-containing crankcase ventilation gas enters the housing 7 through the gas inlet 8. The oil-mist-containing crankcase ventilation gas enters the housing 8 in the direction of the main flow direction 12. As indicated by the arrows in FIG. 1, the oil-mist-containing crankcase ventilation gas flows laterally past the plate-shaped and rotationally symmetrical throttle diaphragm 10 and exits through a circumferential nozzle gap 26 between the annular shoulder 29 of the throttle diaphragm 10, which acts as a throttle body, and the edge 25 of the opening 15. Adjoining the circumferential nozzle gap 26 in the flow direction there is a baffle 11*a* as an inertial oil separator 11, which preferably has a separation-effective functional face 11*b* such as a nonwoven material or textile, but the oil separator can also be an oil separator which is not shown and is based mainly on the diffusion separation principle.

In the oil-separating device 1 shown in the drawings, oil separation takes place by sharp deflection of the crankcase ventilation gas at the baffle 11*a* or the separation-effective functional face 11*b*, said gas being maximally accelerated through the narrow nozzle gap 26 to increase the oil separation. The sharp deflection of the crankcase ventilation gas which meets the baffle 11*a* or the separation-effective functional face 11*b* at high speed means that the oil mist particles cannot follow owing to their mass inertia and are deposited on the baffle 11*a* or on the functional face 11*b*. The separated-out oil is conveyed back into the crankcase.

During operation of the oil-separating device, a nozzle gap 26 is set which is adapted to the respective operating conditions and consequently is variable rather than constant, and the cross-section thereof is always set by means of self-regulating regulation logic such that the pressure loss of the nozzle gap 26 is at most equal to the currently available negative intake pressure, resulting in a crankcase pressure in the order of magnitude of atmospheric pressure or preferably a slight negative pressure in the single-digit millibar range as a target variable or setpoint value of the regulation. In this state, there is the smallest possible nozzle gap cross-section which can be set without generating a crankcase overpressure. Owing to the crankcase ventilation gas which is virtually independent of counter pressure, the flow speeds with the smallest possible nozzle gap are consequently maximal. Owing to the virtually full use of the negative intake pressure to accelerate the crankcase ventilation gas to maximum flow speed in all engine characteristic map ranges, an optimal degree of oil separation always results at the baffle 11*a* or functional face 11*b*.

This self-regulating behaviour of the nozzle gap cross-section is implemented by applying atmospheric pressure to the throttle diaphragm 10 on the side facing away from the crankcase ventilation gas. The atmospheric pressure on the side of the throttle diaphragm 10 facing away from the gas inlet 8 acts as a reference pressure to the order of magnitude of which the crankcase pressure should be adjusted. To achieve this, the nozzle gap 26 is preferably arranged at a diameter which should be only at most 15% smaller than the diameter of the throttle diaphragm supporting face 31. This results in effective force application faces for the atmospheric pressure on the side of the throttle diaphragm 10 facing away from the gas inlet 8 and on the side of the throttle diaphragm 19 which faces the gas inlet 8. By dimensioning the side of the throttle diaphragm 10 to which crankcase pressure is applied to an area approximately of the side of the throttle diaphragm 10 to which atmospheric pressure is applied, the remaining annular face between the throttle diaphragm supporting face 31 and the nozzle gap 26 is correspondingly small. This has the advantage that only a small annular force application face of the throttle diaphragm 10 is exposed to the negative intake pressure present. As a result, not only are the mechanical loads on the throttle diaphragm 10 at high negative intake pressures minimised, but also a minimally small throttle diaphragm force application face for the negative intake pressure leads to improved regulation behaviour, since the regulation should take place between atmospheric and crankcase pressure and the negative intake pressure acts on the regulation as a disturbance variable. If the diaphragm force application face is too large for the negative intake pressure, a correspondingly higher force acts in the closing direction of the throttle diaphragm 10 and can be compensated only partially by a counter force via e.g. a spring element in the opening direction without the regulation behaviour being impaired thereby.

In addition, the arrangement of the nozzle gap 26 at the largest possible diameter in relation to the diameter of the housing 7 has the advantage that, even with very small oil separators as are used in housings of cylinder head covers according to the prior art, even with a very small opening gap of the nozzle gap 26 in the order of magnitude of a few tenths of a millimetre to a few millimetres, a large flow cross-section is opened, so that even with low negative intake pressures and high crankcase ventilation gas volumetric flows a nozzle gap 26 large enough to avoid crankcase overpressures can be ensured.

In FIG. 14, the oil-separating device 1 is shown in a situation in which the throttle diaphragm supporting face 31 extends inwards beyond the separation-effective functional face 11*b* into the immediate vicinity of the annular shoulder 29 of the diaphragm. This embodiment with the throttle diaphragm supporting face 31 protruding beyond the separation-effective functional face 11*b* has the advantage that a degree of design freedom results which allows the radial distance of the separation-effective functional face 11*b* from the nozzle gap 26 to be adapted in design terms independently of the inner diameter 33 of the throttle diaphragm supporting face 31. This design makes it possible to make the distance of the separation-effective functional face 11*b* from the nozzle gap 26 greater than the radial distance of the inner diameter 33 of the throttle diaphragm supporting face 31, in order on the one hand to be able to select the optimal distance for oil mist particle separation of the separation-effective functional face 11*b* from the nozzle gap 26 and on the other hand, independently of this, to keep the force application face for the negative intake pressure, substantially between the inner diameter 33 of the throttle diaphragm supporting face 31 and the circumferential shoulder 29, as small as possible for the benefit of the optimal regulation behaviour.

It should be ensured in design terms that, when the diaphragm flexing region 30 rests fully on the throttle diaphragm supporting face 31, the annular shoulder 29 at the same time comes to rest on the edge 25 of the opening 15, as shown in FIG. 13, or else the annular shoulder 29 still has a minimal distance from the edge 25 of the opening 15, which can be closed by means of a slight deformation of the small portion of the diaphragm flexing region 30 which protrudes inwards beyond the throttle diaphragm supporting face 31, in order to allow complete sealing of the annular shoulder 29 on the edge 25 of the opening 15.

Without a stationary throttle diaphragm supporting face 31 for the diaphragm flexing region 30, the throttle diaphragm 10 in the diaphragm flexing region 30 would be pulled in the direction of the negative intake pressure by the pressure difference between atmospheric pressure and the negative intake pressure, in particular with larger radial distances of the baffle 11*a*. A force acts on the throttle diaphragm 10 in the closing direction; without an additional counter force in the opening direction, for example from a spring element, said force would result in a nozzle gap 26 which is too small and, as a consequence of that, a crankcase overpressure. The throttle diaphragm supporting face 31 for the diaphragm flexing region 30, as a stop face, prevents the throttle diaphragm 10 in the diaphragm flexing region 30 being pulled in the direction of the negative intake pressure. Correspondingly, additional forces in the closing direction of the throttle diaphragm 10 are thereby minimised or avoided completely. As a result, a spring element 52 for applying an additional opening force, in particular when the use in question requires only small nozzle gap cross-sections, is not absolutely necessary to keep the crankcase pressure at atmospheric pressure level.

Preferably, if an additional spring element is omitted, a distance between the annular shoulder 29 of the throttle diaphragm 10 and the edge 25 of the opening 15 in the order of magnitude of a few tenths should be provided when the diaphragm flexing region 30 rests fully on the throttle diaphragm supporting face 31. This gap can shift the crankcase pressure level slightly into the order of magnitude of a single-digit negative pressure in millibars. Here, use is made of the elastic behaviour of the small diaphragm flexing region portion which protrudes inwards over the throttle diaphragm supporting face 31 and can deform in a similar manner to a spring under the application of force and assumes the function of the spring element 52. Owing to the elasticity of the overhanging diaphragm flexing region portion, the provided nozzle gap 26 can also close completely when there is negative intake pressure but no crankcase ventilation gas volumetric flow and thus allow the necessary gastight sealing between the annular shoulder 29 and the edge 25 of the opening 15.

The change in the nozzle gap cross-section during regulation of the oil-separating device 1 according to the invention is described below.

Starting from a completely closed state (see for example FIG. 13) of the regulator in the form of the throttle diaphragm 10 in the region of the nozzle gap 26 which is present as soon as a negative intake pressure is effective without a crankcase ventilation gas volumetric flow, the throttle diaphragm 10 lifts off the edge 25 of the opening 15 and opens the nozzle gap 26 in the region between the annular shoulder 29 of the throttle diaphragm 10 and the edge 25 of the opening 15 (see for example FIG. 14) as soon as a minimum crankcase ventilation gas volumetric flow is present.

The lifting off of the throttle diaphragm 10 and the resulting opening of the nozzle gap 26 is made possible by a slight partial lifting of the diaphragm flexing region 30 off the throttle diaphragm supporting face 31. The lifting off of the throttle diaphragm supporting face 31 takes place in the form of a rolling off, similar to a peeling off, so that in the case of small nozzle gaps 26 most of the diameter of the diaphragm flexing region 30 continues to rest on the throttle diaphragm supporting face 31. This has the function-critical advantage that the force application face for the negative intake pressure is enlarged only slightly by the likewise slight lifting off of the diaphragm flexing region 30, so that the forces acting in the closing direction on the diaphragm flexing region 30 are very low, even at higher negative intake pressures as are known in petrol engines or with the use of additional powerful vacuum generators, and have hardly any effect on the regulation behaviour.

The maximum nozzle gap 26 is present (see for example FIG. 15) when the negative intake pressure is low and the crankcase ventilation gas volumetric flows are high. In this state, a larger portion of the diaphragm flexing region 30 is lifted off the throttle diaphragm supporting face 31. In this state, the force application face in the diaphragm flexing region 30 would be greater; however, since the negative intakes pressures in this state are lower, the forces acting in the closing direction and the resulting effects on the regulation behaviour are correspondingly low.

The regulated oil separator 1 according to the invention with the plate-shaped throttle diaphragm 10 which in combination with the supporting plate 18 assumes the function of the regulator exhibits the regulation behaviour described below during operation of an engine without an additional vacuum generator in the crankcase ventilation system:

In engine operating states at low engine speed, which results in a correspondingly low negative intake pipe pressure, a low load and a low ventilation gas volumetric flow, the regulator or the throttle diaphragm 10 will open a large or even the maximum flow cross-section of the nozzle gap 26, comparable with the starting state without a differential pressure, which, in combination with at the same time low ventilation gas volumetric flows, results in lower flow speeds and lower pressure losses in the nozzle gap 26.

If the engine speed is increased to a high speed while the load remains low, the negative intake pipe pressure increases while the ventilation gas volumetric flow remains virtually the same. The high negative intake pipe pressure and the initially still low pressure loss in the nozzle gap 26 result in a rise in the negative crankcase pressure, i.e. a larger pressure difference in relation to the side of the regulator or the throttle diaphragm 10 to which atmospheric pressure is applied; as a result of this, said throttle diaphragm moves in the direction of the pressure gradient and reduces the flow cross-section of the nozzle gap 26 until the pressure loss rising in the process reduces the negative crankcase pressure to the setpoint value.

If, starting from the above engine operating state with high engine speed and low load, the load is increased to high load, the ventilation gas volumetric flow increases at the initially still small flow cross-section of the nozzle gap 26, which generates a higher pressure loss and thus reduces the negative crankcase pressure. As soon as the negative crankcase pressure falls to a value below the setpoint value, the regulator is shifted by the spring element 52 on the crankcase side, counter to a still low force of the regulator, in the direction of larger nozzle gap cross-sections until the resulting lower pressure loss allows the negative crankcase pressure to rise to the setpoint value.

The above-described regulation behaviour relates to the regulation behaviour of the regulated separator when used in a crankcase ventilation system of a conventional internal combustion engine without an additional vacuum generator.

If an additional vacuum generator is used, such as an eductor pump or an electrical pump, the separation performance will increase.

The regulation or the nozzle gap 26 produced then depends on the negative pressure generated by the vacuum generator in combination with the crankcase ventilation gas volumetric flow and no longer directly on the engine speed of the internal combustion engine.

The regulated oil-separating device 1 according to the invention consists of a modular functional assembly which accelerates the flow speed of the ventilation gas volumetric flow maximally via the variable nozzle gap 26 using virtually all the power available in the crankcase ventilation system and of an adjoining functional element in the form of an oil separator 11 on which the nozzle jet impinges for oil mist separation.

The regulation loop can generally be described as follows: With unregulated oil separators, the negative crankcase pressure of an internal combustion engine varies depending on the engine operating state and results from the difference between the negative intake pipe pressure and the oil separator pressure loss, which depends on the ventilation volumetric flow (negative intake pipe pressure–oil separator pressure loss=crankcase pressure). To keep the crankcase pressure at a constant minimum negative pressure level to use the maximum available crankcase ventilation power, a regulated adjustment of the pressure loss is required according to the invention.

The pressure difference between atmospheric pressure and crankcase pressure acts as a controlled variable for the regulator, consisting of the throttle diaphragm 10 and the supporting plate 18. A constant low negative crankcase pressure (crankcase pressure [absolute]–atmospheric pressure [absolute]<0) is the intended setpoint value for the controlled variable independently of the engine operating states.

As soon as the pressure difference between atmospheric pressure and crankcase pressure as the controlled variable changes slightly from an equilibrium state during engine operation, there is correspondingly a slight deviation from the setpoint value, and the throttle diaphragm 10 executes a relative movement in the direction of the pressure gradient. This relative movement of the throttle diaphragm 10 is used to mechanically adjust the flow cross-section of the nozzle gap 26 and thus indirectly the pressure loss of the oil-separating device 1 as a manipulated variable such that the constant low negative crankcase pressure as the setpoint value of the controlled variable is met again (feedback). It is of particular significance for the regulation function that the flow cross-section of the nozzle gap 26 can be changed so that an impairment of the regulation function owing to the dynamic pressure at the nozzle gap inlet or the pressure difference between the dynamic pressure and the crankcase pressure can be prevented or at least reduced. The pressure difference between atmospheric pressure and crankcase pressure as the controlled variable, the relative movement of the regulator and the changing pressure loss as a result of the change in the flow cross-section of the nozzle gap 26 as the manipulated variable, and the feedback of the manipulated variable to the controlled variable until the low negative crankcase pressure has been re-established as the setpoint value, produce a closed control loop. Since this is a self-regulating process, the individual steps of the control loop take place continuously and without a time delay so that the intended low negative crankcase pressure as the setpoint value of the controlled variable is always maintained.

The spring constant of the spring element 52 on the crankcase side can be used to determine the magnitude of the low negative crankcase pressure which is to be adjusted as the setpoint value. Without the spring element 52, a crankcase pressure in the order of magnitude of the atmospheric pressure would result in the preferred embodiment according to FIG. 13 as described above. As the spring constant of the spring element 52 rises, the force required to shift the regulator in the direction of smaller nozzle gaps 26 increases, i.e. the regulator narrows the nozzle gap 26 to the same flow cross-section only at higher negative crankcase pressures. Owing to the on average larger flow cross-section of the nozzle gap 26 with a crankcase-side spring element 52 with a larger spring constant, the average pressure loss will be correspondingly lower and the negative crankcase pressure will be greater. The pressure loss which is produced at the nozzle gap 26 is directly related to the flow speeds in and downstream of the nozzle gap 26. The greater the flow speed at which the flow arrives at the inertial oil separator 11 adjoining the nozzle gap 26, the greater the potential for a high degree of oil separation. Therefore, the smallest possible spring constant should preferably be selected for the crankcase-side spring element 52, to achieve high flow speeds in the nozzle gap 26 for maximum oil separation.

In engine operating states at low engine speed, which results in a correspondingly low negative intake pipe pressure, and a low load, which results in a low ventilation gas volumetric flow, the regulator will open a large or even the maximum flow cross-section of the nozzle gap 26, comparable with the starting state without a differential pressure, which, in combination with at the same time low ventilation gas volumetric flows, results in lower flow speeds and lower pressure losses in the nozzle gap 26.

If the engine speed is increased to a high speed while the load remains low, the negative intake pipe pressure increases while the ventilation gas volumetric flow remains virtually the same. The high negative intake pipe pressure and the initially still low pressure loss in the nozzle gap 26 result in a rise in the negative crankcase pressure, i.e. a larger pressure difference in relation to the side of the regulator or the throttle diaphragm 10 to which atmospheric pressure is applied; as a result of this, said throttle diaphragm moves in the direction of the pressure gradient and closes the flow cross-section of the nozzle gap 26 until the pressure loss rising in the process reduces the negative crankcase pressure to the setpoint value.

If, starting from the above engine operating state with high engine speed and low load, the load is increased to high load, the ventilation gas volumetric flow increases, which, at the initially still small flow cross-section of the nozzle gap 26, generates a higher pressure loss and thus reduces the negative crankcase pressure. As soon as the negative crankcase pressure falls to a value below the low crankcase pressure of the setpoint value, the regulator is shifted by the spring element 52, counter to a still low force of the regulator, in the direction of a larger nozzle gap cross-section until the resulting lower pressure loss allows the negative crankcase pressure to rise to the setpoint value.

The oil-separating device according to the invention has in particular the following advantages over unregulated oil separators:

- higher potential for higher degrees of oil separation thanks to the utilisation of all the available power in the crankcase ventilation system;
- omission of the pressure regulation valve as a consequence/side effect;
- simplification of the design of the oil separator and cylinder head cover thanks to the omission of the externally attached pressure regulation valve;
- lower outlay on assembly thanks to the omission of the pressure regulation valve;
- modular structure (function of module can be checked before installation in the assembly);
- cost-saving potential as a result of the above four points;
- no leakage risk from an externally attached pressure regulation valve;
- no need to form variants of the separator (maximum permissible pressure loss results automatically depending on the engine and the operating conditions);
- adapts automatically to time-variable conditions (for example, higher blow-by volumetric flow owing to engine wear, full air filter=>higher negative intake pipe pressures);
- better resistance of the oil to being pulled off (regulated oil separator does not increase the pressure loss with additional external blow-by=> better drainage of the separated-out oil);
- avoidance of overpressures in critical characteristic map ranges (low engine speed, high load) despite maximum utilisation of the power in all characteristic map ranges;
- no electronics needed, as self-regulating;
- no higher fuel consumption (in comparison with actively driven oil separators);

Furthermore, the oil-separating device according to the invention can in particular have the following advantages over known regulated oil separators:

- lower tolerance requirements;
- fewer mechanically moving components;
- no static or dynamic friction forces when adjusting the throttle diaphragm or the cross-section of the nozzle gap;
- the change in the cross-section of the nozzle gap takes place contactlessly in the region of the nozzle gap 26;
- very compact design owing to the plate-shaped throttle diaphragm 10;
- unlimited regulation range; all the crankcase ventilation gas volumetric flow is conducted through the nozzle gap; no additional flow cross-sections necessary as a bypass of the disclosed oil-separating device;
- high mechanical resistance of the plate-shaped throttle diaphragm 10 to high negative intake pressures thanks to the throttle diaphragm supporting face 31;
- high resistance of the throttle diaphragm to the positive crankcase pressures which are applied during positive pressure leak testing by the manufacturer of the internal combustion engine before commissioning of the internal combustion engine.

The invention claimed is:

1. An oil-separating device for cleaning crankcase ventilation gases, comprising:

a housing which has a gas inlet, which can be flow-connected to a crankcase, and an outlet, which can be flow-connected to an intake region of an internal combustion engine, and an oil separator arranged in the housing between the gas inlet and the outlet, a gas duct extending inside the housing and being flow-connected to the gas inlet, an opening on which a plate-shaped throttle diaphragm is arranged being formed at a longitudinal end of the gas duct, said longitudinal end facing away from the gas inlet, and the throttle diaphragm being mounted in the housing such that it can move in the longitudinal direction of the gas duct between a closed position, in which the throttle diaphragm rests on an edge of the opening of the gas duct and closes the opening, and an open position, in which a circumferential nozzle gap is formed between the edge of the opening and the throttle diaphragm, the gas duct being surrounded at least in some sections by an outlet duct flow-connected to the outlet, and the gas duct and the outlet duct forming an annular gap through which crankcase ventilation gases can flow from the gas duct into the annular gap via the nozzle gap when the throttle diaphragm is in the open position, the oil separator being attached to the outlet duct on the inside of the annular gap and in a flow path, running transversely to the longitudinal direction of the gas duct, of the crankcase ventilation gases flowing through the nozzle gap, and the housing having an additional opening to which a reference pressure can be applied on the side of the throttle diaphragm facing away from the gas duct, wherein the throttle diaphragm is designed to extend radially beyond the annular gap and has a sealing region moulded onto the edge, said sealing region being sealingly arranged in a recess formed in the housing such that the throttle diaphragm fluidically separates the additional opening from the gas inlet, and wherein the throttle diaphragm has a circumferential shoulder which is formed on the side of the throttle diaphragm facing the gas duct and rests on the edge of the opening of the gas duct when the throttle diaphragm is in the closed position, wherein the nozzle gap is formed between the edge of the opening and the circumferential shoulder of the throttle diaphragm when the throttle diaphragm is in the open position.

2. The oil-separating device according to claim 1, wherein there is a circumferential throttle diaphragm supporting face between the sealing region and the edge of the opening as seen in the radial direction, on which throttle diaphragm supporting face a circumferential and elastically deformable diaphragm flexing region of the throttle diaphragm rests in a supported manner, at least in the closed position.

3. The oil-separating device according to claim 2, wherein the throttle diaphragm supporting face extends radially inwards as far as the circumferential shoulder of the throttle diaphragm.

4. The oil-separating device according to claim 2, wherein the nozzle gap is arranged at a diameter, in relation to the throttle diaphragm, which is at most 15% smaller than an inner diameter of the throttle diaphragm supporting face.

5. The oil-separating device according to claim 2, wherein the throttle diaphragm supporting face is in the form of a first flange of a profiled element, wherein a second flange forms a direct impact face of the oil separator or acts as an attachment face for a separation-effective functional face.

6. The oil-separating device according to claim 2, wherein the inner diameter of the throttle diaphragm supporting face is smaller than the inner diameter of the impact face and is smaller than the inner diameter of the separation-effective functional face.

7. The oil-separating device according to claim 1, wherein the annular gap has at least one bearing face on which the oil separator is held, resting thereon.

8. The oil-separating device according to claim 1, wherein the throttle diaphragm is mounted on the housing such that it can move in the direction of the closed position, counter to the force of an elastic spring element in the opening direction, wherein the elastic spring element is supported both on the housing and on the side of the throttle diaphragm facing the gas duct.

9. The oil-separating device according to claim 1, wherein the oil separator has a separation-effective functional face, in particular a textile.

10. The oil-separating device according to claim 1, wherein the outlet is flow-connected to a vacuum generator, in particular an eductor pump.

11. The oil-separating device according to claim 1, wherein the reference pressure on the side of the throttle diaphragm facing away from the gas duct is atmospheric pressure.

12. The oil-separating device according to claim 1, wherein the oil-separating device is in the form of a modular functional assembly.

13. The oil-separating device according to claim 12, wherein the oil-separating device in the form of a modular functional assembly is used in a crankcase ventilation gas conducting housing element and the spatially gastight separation of contaminated from cleaned crankcase ventilation gases and of cleaned crankcase ventilation gases from ambient air at atmospheric pressure level takes place by means of seals or a gastight weld.

14. The oil-separating device according to claim 1, wherein the perimeter of the circumferential nozzle gap and/or the housing has substantially a circular or oval or angular contour.

* * * * *